US006475960B1

(12) United States Patent
Berlowitz et al.

(10) Patent No.: US 6,475,960 B1
(45) **Date of Patent: *Nov. 5, 2002**

(54) PREMIUM SYNTHETIC LUBRICANTS

(75) Inventors: Paul J. Berlowitz, E. Windsor; Jacob J. Habeeb, Westfield, both of NJ (US); Robert J. Wittenbrink, Baton Rouge, LA (US)

(73) Assignee: ExxonMobil Research and Engineering Co., Annandale, NJ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/148,382

(22) Filed: Sep. 4, 1998

(51) Int. Cl.[7] ..... C10M 105/00; C10M 141/00

(52) U.S. Cl. ..... 508/110; 585/1; 585/2; 208/18; 208/19

(58) Field of Search ..... 508/110; 585/1, 585/2; 208/18, 19

(56) References Cited

U.S. PATENT DOCUMENTS

| | | | | |
|---|---|---|---|---|
| 3,188,286 A | | 6/1965 | Van Driesen | 208/108 |
| 3,268,439 A | | 8/1966 | Tupman et al. | 208/112 |
| 3,365,390 A | | 1/1968 | Egan et al. | 208/60 |
| 3,539,499 A | | 11/1970 | Morris et al. | 208/111 |
| 3,830,723 A | | 8/1974 | Ladeur et al. | 208/108 |
| 4,057,488 A | | 11/1977 | Montagna et al. | 208/89 |
| 4,059,534 A | | 11/1977 | Morro et al. | 252/32.7 E |
| 4,487,688 A | | 12/1984 | Dessau | 208/310 Z |
| 4,500,417 A | | 2/1985 | Chen et al. | 208/111 |
| 4,704,491 A | | 11/1987 | Ohtake et al. | 585/10 |
| 4,749,467 A | | 6/1988 | Chen et al. | 208/59 |
| 4,827,064 A | | 5/1989 | Wu | 585/10 |
| 4,832,819 A | | 5/1989 | Hamner | 208/27 |
| 4,906,350 A | | 3/1990 | Lucien et al. | 208/197 |
| 4,919,786 A | | 4/1990 | Hamner et al. | 208/27 |
| 4,935,120 A | | 6/1990 | Lipinski et al. | 208/59 |
| 4,943,672 A | | 7/1990 | Hamner et al. | 585/737 |
| 5,015,361 A | | 5/1991 | Anthes et al. | 208/111 |
| 5,037,528 A | | 8/1991 | Garwood et al. | 208/27 |
| 5,059,299 A | | 10/1991 | Cody et al. | 208/27 |
| 5,075,269 A | | 12/1991 | Degnan et al. | 502/77 |
| 5,096,883 A | | 3/1992 | Mercer et al. | 507/103 |
| 5,107,054 A | | 4/1992 | Del Rossi et al. | 585/739 |
| 5,110,445 A | | 5/1992 | Chen et al. | 208/96 |
| 5,120,425 A | | 6/1992 | Zones et al. | 208/46 |
| 5,135,638 A | | 8/1992 | Miller | 208/27 |
| 5,189,012 A | | 2/1993 | Patel et al. | 507/103 |
| 5,229,021 A | | 7/1993 | Pillon et al. | 252/56 R |
| 5,246,568 A | | 9/1993 | Forbus et al. | 208/59 |
| 5,362,378 A | | 11/1994 | Borghard et al. | 208/138 |
| 5,404,015 A | | 4/1995 | Chimenti et al. | 250/339.12 |
| 5,419,185 A | | 5/1995 | Chimenti et al. | 73/54.01 |
| 5,422,375 A | | 6/1995 | Rytter et al. | 518/700 |
| 5,424,542 A | | 6/1995 | Chimenti et al. | 250/339.12 |
| 5,426,053 A | | 6/1995 | Chimenti et al. | 436/55 |
| 5,466,364 A | | 11/1995 | Kaul et al. | 208/307 |
| 5,475,612 A | | 12/1995 | Espinosa et al. | 364/500 |
| 5,498,596 A | | 3/1996 | Ashjian et al. | 507/103 |
| 5,569,642 A | | 10/1996 | Lin | 507/103 |
| 5,733,839 A | | 3/1998 | Espinosa et al. | 502/336 |
| 5,750,819 A | | 5/1998 | Wittenbrink et al. | 585/734 |
| 5,756,420 A | | 5/1998 | Wittenbrink et al. | 502/313 |
| 5,763,374 A | * | 6/1998 | Sakai et al. | 508/469 |
| 5,833,839 A | | 11/1998 | Wittenbrink et al. | 208/112 |
| 5,866,748 A | | 2/1999 | Wittenbrink et al. | 585/734 |
| 5,882,505 A | | 3/1999 | Wittenbrink et al. | 208/59 |
| 5,888,376 A | | 3/1999 | Wittenbrink et al. | 208/59 |
| 5,958,845 A | | 9/1999 | Van Slyke | 507/103 |
| 5,965,475 A | | 10/1999 | Wittenbrink et al. | 502/66 |
| 6,008,164 A | | 12/1999 | Aldrich et al. | 508/110 |
| 6,025,305 A | | 2/2000 | Aldrich et al. | 508/110 |
| 6,080,301 A | * | 6/2000 | Berlowitz et al. | 208/18 |
| 6,090,989 A | * | 7/2000 | Trewella et al. | 585/13 |
| 6,096,690 A | | 8/2000 | Wittenbrink et al. | 507/103 |

(List continued on next page.)

FOREIGN PATENT DOCUMENTS

| | | | |
|---|---|---|---|
| CA | 1090275 | 11/1980 | C10M/1/04 |
| EP | 2117429 A | 10/1983 | C09K/7/06 |
| EP | 0454256 A2 | 10/1991 | C07C/1/04 |
| EP | 0323092 B1 | 4/1992 | C10G/45/62 |

(List continued on next page.)

OTHER PUBLICATIONS

Foder, G.E., "Analysis of Petroleum Fuels by Midband Infrared Spectroscopy", SAE Technical Paper Series 941019, International Congress & Exposition, Detroit, Michigan, Feb. 28—Mar. 3, 1994.

(List continued on next page.)

*Primary Examiner*—Cephia D. Toomer
(74) *Attorney, Agent, or Firm*—Linda M Scuorzo; Mark D. Marin

(57) ABSTRACT

Premium synthetic lubricants comprise a synthetic isoparaffinic hydrocarbon base stock and an effective amount of at least one, and typically a plurality of lubricant additives such as a detergent, dispersant, antioxidant, antiwear additive, pout point depresant, VI improver and the like. The base stock is derived from a waxy, paraffinic, Fischer-Tropsch synthesized hydrocarbon feed fraction having an initial boiling point in the range of about 650–750° F. and continuously boiling up to at least 1050° F., by a process which comprises hydroisomerizing the feed and dewaxing the isomerate. The waxy feed has a $T_{90}$–$T_{10}$ temperature difference of at least 350° F. and is preferably hydroisomerized without any pretreatment, other than optional fractionation. The lubricant may also contain hydrocarbonaceous and synthetic base stock material. Lubricants, such as fully formulated multigrade automotive crankcase and transmission oils formed by adding a suitable additive package to the isoparaffinic base stock have exhibited performance superior to similar fully formulated oils based on both PAO and conventional, petroleum derived base stocks.

30 Claims, No Drawings

U.S. PATENT DOCUMENTS

| | | | | |
|---|---|---|---|---|
| 6,096,940 | A | 8/2000 | Wittenbrink et al. | 585/750 |
| 6,103,099 | A | 8/2000 | Wittenbrink et al. | 208/27 |
| 6,165,949 | A | 12/2000 | Berlowitz et al. | 508/363 |
| 6,179,994 | B1 | 1/2001 | Clark et al. | 208/27 |
| 6,190,532 | B1 | 2/2001 | Degnan et al. | 208/27 |

FOREIGN PATENT DOCUMENTS

| | | | | |
|---|---|---|---|---|
| EP | 0225053 | B1 | 7/1992 | C10G/65/04 |
| EP | 0512635 | A2 | 11/1992 | C07C/1/08 |
| EP | 0533227 | A1 | 3/1993 | C07C/1/04 |
| EP | 0321307 | B1 | 4/1993 | C10G/67/04 |
| EP | 0553924 | A1 | 8/1993 | C01B/3/28 |
| EP | 0576096 | A2 | 12/1993 | C01B/3/38 |
| EP | 0579330 | A1 | 1/1994 | C10G/2/00 |
| EP | 0582337 | A1 | 2/1994 | B01D/53/34 |
| EP | 0627958 | B1 | 12/1994 | B01J/8/22 |
| EP | 0627959 | B2 | 12/1994 | B01J/8/22 |
| EP | 0629578 | A1 | 12/1994 | C01B/3/40 |
| EP | 0640559 | A1 | 3/1995 | C01B/3/38 |
| EP | 0640561 | A1 | 3/1995 | C01B/3/40 |
| EP | 0656317 | A1 | 6/1995 | C10B/3/40 |
| EP | 0661374 | A1 | 7/1995 | C10K/1/34 |
| EP | 0668342 | A1 | 8/1995 | C10G/65/04 |
| EP | 0668342 | | 8/1995 | C10G/65/04 |
| EP | 0776959 | A2 | 6/1997 | C10G/65/04 |
| EP | 0776959 | | 6/1997 | C10G/65/04 |
| EP | 0794239 | A1 | 9/1997 | C10G/2/00 |
| EP | 0820806 | A1 | 1/1998 | B01J/8/00 |
| EP | 0823470 | A1 | 2/1998 | C10G/2/00 |
| EP | 0824961 | A1 | 2/1998 | B01J/8/22 |
| EP | 0955093 | A1 | 11/1999 | B01J/29/48 |
| EP | 0967262 | A1 | 12/1999 | C10G/69/02 |
| EP | 1004561 | A1 | 5/2000 | C07C/1/04 |
| GB | 1572793 | | 8/1980 | C10M/1/04 |
| WO | WO93/16796 | | 9/1993 | B01J/8/22 |
| WO | WO94/26656 | | 11/1994 | C01B/3/38 |
| WO | WO9506694 | | 3/1995 | C09K/7/06 |
| WO | WO9509215 | | 4/1995 | C09K/7/00 |
| WO | WO95/13340 | | 5/1995 | C10K/1/20 |
| WO | WO95/18062 | | 7/1995 | C01B/3/40 |
| WO | WO95/18063 | | 7/1995 | C01B/3/40 |
| WO | WO95/18782 | | 7/1995 | C07C/2/02 |
| WO | WO97/09397 | | 3/1997 | C10G/45/64 |
| WO | 9714769 | | 4/1997 | |
| WO | WO97/17137 | | 5/1997 | B01J/37/18 |
| WO | WO9721787 | | 6/1997 | C10G/45/58 |
| WO | WO9721788 | | 6/1997 | C10G/67/04 |
| WO | WO98/05423 | | 2/1998 | B01J/35/04 |
| WO | WO98/06487 | | 2/1998 | B01J/8/22 |
| WO | WO98/07511 | | 2/1998 | B01J/8/22 |
| WO | WO98/11037 | | 3/1998 | C07C/1/04 |
| WO | 9830306 | | 7/1998 | |
| WO | WO98/37168 | | 8/1998 | C10G/45/16 |
| WO | WO99/00191 | | 1/1999 | B01J/38/00 |
| WO | WO99/03574 | | 1/1999 | B01J/8/22 |
| WO | WO99/15483 | | 4/1999 | C07C/1/04 |
| WO | WO99/15484 | | 4/1999 | C07C/1/06 |
| WO | WO9920720 | | 4/1999 | C10M/143/08 |
| WO | WO99/52993 | | 10/1999 | C10G/65/12 |
| WO | WO00/11113 | | 3/2000 | C10G/7/00 |
| WO | WO00/20534 | | 4/2000 | C10L/1/08 |
| WO | WO00/20535 | | 4/2000 | C10L/1/08 |
| WO | WO00/29511 | | 5/2000 | C10G/45/64 |
| WO | WO00/34414 | | 6/2000 | C10G/2/00 |
| WO | WO00/38828 | | 7/2000 | B01J/8/00 |
| WO | WO00/45948 | | 8/2000 | B01J/8/22 |
| WO | WO00/48969 | | 8/2000 | C07C/1/04 |
| WO | WO00/60029 | | 10/2000 | C10L/1/08 |
| WO | WO00/61707 | | 10/2000 | C10L/1/00 |
| WO | WO00/63141 | | 10/2000 | C07C/1/04 |
| WO | WO00/77125 | A1 | 12/2000 | C10G/25/00 |

OTHER PUBLICATIONS

Petrova, L.M., et al., "Composition and Properties of Lube Oils from Heavy Crudes Produced from Permian Deposits", Chemistry and Technology of Fuels and Oils, vol. 31, Nos. 5–6, 1995, A.E. Arbuzov Institute of Organic and Physical Chemistry (IOFKh), Kazan Scientific Center of the Russian Academy of Sciences (KNTs RAN), translated from Khimiya i Tekhnologiya Topliv i Masel, No. 5, pp. 33–35, Sep.–Oct. 1995.

Cranton, G. E., "Compositin and Oxidation of Petroleum Fractions", Thermochimica Acta, 14 (1976) 201–208, Elsevier Scientific Publishing Company, Amsterdam, presented at 5th North American Thermal Analysis Society meeting, Peterborough, Ontario, Jun. 8–14, 1975.

Garrigues, S., et al., "Multivariate calibrations in Fourier transform infrared spectrometry for prediction of kerosene properties", Analytica Chimica Acta 317 (1995) 95–105, Elsevier Science B.V., SSDI 0003–2670(95)00407–6.

* cited by examiner

PREMIUM SYNTHETIC LUBRICANTS

BACKGROUND OF THE DISCLOSURE

1. Field of the Invention

The invention relates to lubricants based on premium synthetic lubricant base stocks derived from waxy Fischer-Tropsch hydrocarbons, their preparation and use. More particularly the invention relates to fully formulated lubricants comprising an admixture of an effective amount of lubricant additives and a synthetic lubricating oil base stock made by hydroisomerizing waxy, Fischer-Tropsch synthesized hydrocarbons and then dewaxing the hydroisomerate to reduce the pour point.

2. Background of the Invention

Current trends in the design of automotive engines require higher quality crankcase and transmission lubricating oils with high VI's and low pour points. Such lubricating oils are prepared by adding an effective amount of additives, typically in the form of an additive package, to a base stock which is an oil of lubricating quality boiling in the lubricating oil range. Processes for preparing lubricating base stocks from petroleum derived feeds typically include atmospheric and/or vacuum distillation of a crude oil (and often deasphalting the heavy fraction), solvent extraction of the lube fraction to remove aromatic unsaturates and form a raffinate, hydrotreating the raffinate to remove heteroatom compounds and remove aromatics, followed by either solvent or catalytically dewaxing the hydrotreated raffinate to reduce the pour point of the oil. Some synthetic lubricating oils are based on a polymerization product of polyalphaolefins (PAO). These lubricating oils are expensive and can shrink seals. In the search for better lubricating oils, attention has recently been focused on Fischer-Tropsch wax that has been synthesized by reacting $H_2$ with CO.

Fischer-Tropsch wax is a term used to describe waxy hydrocarbons produced by a Fischer-Tropsch hydrocarbon synthesis processes in which a synthesis gas feed comprising a mixture of $H_2$ and CO is contacted with a Fischer-Tropsch catalyst, so that the $H_2$ and CO react under conditions effective to form hydrocarbons. The waxy fraction used to prepare lubricating oil base stocks typically has an initial boiling point in the range of from 650–750° F. U.S. Pat. No. 4,943,672 discloses a process for converting waxy Fischer-Tropsch hydrocarbons to a lube oil base stock having a high (viscosity index) VI and a low pour point, wherein the process comprises sequentially hydrotreating, hydroisomerizing, and solvent dewaxing. A preferred embodiment comprises sequentially (i) severely hydrotreating the wax to remove impurities and partially convert it, (ii) hydroisomerizing the hydrotreated wax with a noble metal on a fluorided alumina catalyst, (iii) hydrorefining the hydroisomerate, (iv) fractionating the hydroisomerate to recover a lube oil fraction, and (v) solvent dewaxing the lube oil fraction to produce the base stock. European patent publication EP 0 668 342 A1 suggests a processes for producing lubricating base oils by hydrogenating or hydrotreating and then hydroisomerizing a Fischer-Tropsch wax or waxy raffinate, followed by dewaxing, while EP 0 776 959 A2 recites hydroconverting Fischer-Tropsch hydrocarbons having a narrow boiling range, fractionating the hydroconversion effluent into heavy and light fractions and then dewaxing the heavy fraction to form a lubricating base oil having a VI of at least 150.

SUMMARY OF THE INVENTION

The invention relates to fully formulated lubricants which comprise an admixture of an effective amount of lubricant additives and a lubricant base stock derived from waxy, Fischer-Tropsch synthesized hydrocarbons. Lubricant additives vary depending on the desired end use. Therefore, the nature and amount of additives added to, blended or admixed with the base stock will depend on the desired use for the lubricant. However, fully formulated lubricating oils such as motor oils, transmission oils, turbine oils and hydraulic oils all typically contain at least one additive selected from the group consisting of a detergent and/or dispersant, antioxidant, antiwear additive, viscosity index (VI) improver and mixture thereof. Such base stocks have been prepared by a process which comprises hydroisomerizing and dewaxing waxy, highly paraffinic, Fischer-Tropsch hydrocarbons boiling in the lubricating oil range, and preferably including waxy hydrocarbons boiling above the lubricating oil range. Base stocks useful in the practice of the invention have been produced by (i) hydroisomerizing waxy, Fischer-Tropsch synthesized hydrocarbons having an initial boiling point in the range of 650–750° F. and an end point of at least 1050° F. (hereinafter "waxy feed") to form a hydroisomerate having an initial boiling point in said 650–750° F. range, (ii) dewaxing the 650–750° F.+ hydroisomerate to reduce its pour point and form a 650–750° F.+ dewaxate, and (iii) fractionating the 650–750° F.+ dewaxate to form two or more fractions of different viscosity as the base stocks. These base stocks are premium synthetic lubricating oil base stocks of high purity having a high VI, a low pour point and are isoparaffinic, in that they comprise at least 95 wt. % of non-cyclic isoparaffins having a molecular structure in which less than 25% of the total number of carbon atoms are present in the branches, and less than half the branches have two or more carbon atoms. The base stock of the invention and those comprising PAO oil differ from oil derived from petroleum oil or slack wax in an essentially nil heteroatom compound content and in comprising essentially non-cyclic isoparaffins. However, whereas a PAO base stock comprises essentially star-shaped molecules with long branches, the isoparaffins making up the base stock of the invention have mostly methyl branches. This is explained in detail below. Both the base stocks of the invention and fully formulated lubricating oils using them have exhibited properties superior to PAO and conventional mineral oil derived base stocks, and corresponding formulated lubricating oils. Further, while in many cases it will be advantageous to employ only a base stock derived from waxy Fischer-Tropsch hydrocarbons for a particular lubricant, in other cases one or more additional base stocks may be mixed with, added to or blended with one or more of the Fischer-Tropsch derived base stocks. Such additional base stocks may be selected from the group consisting of (i) a hydrocarbonaceous base stock, (ii) a synthetic base stock and mixture thereof. Typical examples include base stocks derived from (a) mineral oil, (b) a mineral oil slack wax hydroisomerate, (c) PAO, and mixture thereof Because the Fischer-Tropsch base stocks of the invention and lubricating oils based on these base stocks are different, and most often superior to, lubricants formed from other base stocks, it will be obvious to the practitioner that a blend of another base stock with at least 20, preferably at least 40 and more preferably at least 60 wt. % of the Fischer-Tropsch derived base stock, will still provide superior properties in many most cases, although to a lesser degree than only if the Fischer-Tropsch derived base stock is used.

The waxy feed used to form the Fischer-Tropsch base stock preferably comprises waxy, highly paraffinic and pure Fischer-Tropsch synthesized hydrocarbons (sometimes referred to as Fischer-Tropsch wax) having an initial boiling point in the range of from 650–7500° F. and continuously boiling up to an end point of at least 1050° F., and preferably above 1050° F. (1050° F.+). It is also preferred that these hydrocarbons have a $T_{90}$–$T_{10}$ temperature spread of at least 350° F. The temperature spread refers to the temperature difference in °F. between the 90 wt. % and 10 wt. % boiling points of the waxy feed, and by waxy is meant including material which solidifies at standard conditions of room temperature and pressure. The hydroisomerization is achieved by reacting the waxy feed with hydrogen in the presence of a suitable hydroisomerization catalyst and preferably a dual function catalyst comprising at least one catalytic metal component to give the catalyst a hydrogenation/dehydrogenation function and an acidic metal oxide component to give the catalyst an acid hydroisomerization function. Preferably the hydroisomerization catalyst comprises a catalytic metal component comprising a Group VIB metal component, a Group VIIH non-noble metal component and an amorphous alumina-silica component. The hydroisomerate is dewaxed to reduce the pour point of the oil, with the dewaxing achieved either catalytically or with the use of solvents, both of which are well known dewaxing processes, with the catalytic dewaxing achieved using any of the well known shape selective catalysts useful for catalytic dewaxing. Both hydroisomerization and catalytic dewaxing convert a portion of the 650–750° F.+ material to lower boiling (650–750° F.–) hydrocarbons. In the practice of the invention, it is preferred that a slurry Fischer-Tropsch hydrocarbon synthesis process be used for synthesizing the waxy feed and particularly one employing a Fischer-Tropsch catalyst comprising a catalytic cobalt component to provide a high alpha for producing the more desirable higher molecular weight paraffins. These processes are also well known to those skilled in the art.

The waxy feed preferably comprises the entire 650–750° F.+ fraction formed by the hydrocarbon synthesis process, with the exact cut point between 650° F. and 750° F. being determined by the practitioner and the exact end point preferably above 1050° F. determined by the catalyst and process variables used for the synthesis. The waxy feed also comprises more than 90%, typically more than 95% and preferably more than 98 wt. % paraffinic hydrocarbons, most of which are normal paraffins. It has negligible amounts of sulfur and nitrogen compounds (e.g., less than 1 wppm), with less than 2,000 wppm, preferably less than 1,000 wppm and more preferably less than 500 wppm of oxygen, in the form of oxygenates. Waxy feeds having these properties and useful in the process of the invention have been made using a slurry Fischer-Tropsch process with a catalyst having a catalytic cobalt component.

In contrast to the process disclosed in U.S. Pat. No. 4,943,672 referred to above, the waxy feed need not be hydrotreated prior to the hydroisomerization and this is a preferred embodiment in the practice of process of the invention. Eliminating the need for hydrotreating the Fischer-Tropsch wax is accomplished by using the relatively pure waxy feed, and preferably in combination with a hydroisomerization catalyst resistant to poisoning and deactivation by oxygenates that may be present in the feed. This is discussed in detail below. After the waxy feed has been hydroisomerized, the hydroisomerate is typically sent to a fractionater to remove the 650–750° F.– boiling fraction and the remaining 650–750° F.+ hydroisomerate dewaxed to reduce its pour point and form a dewaxate comprising the desired lube oil base stock. If desired however, the entire hydroisomerate may be dewaxed. If catalytic dewaxing is used, that portion of the 650–750° F.+ material converted to lower boiling products is removed or separated from the 650–750° F.+ lube oil base stock by fractionation, and the 650–750° F.+ dewaxate fractionated separated into two or more fractions of different viscosity, which are the base stocks of the invention. Similarly, if the 650–750° F.– material is not removed from the hydroisomerate prior to dewaxing, it is separated and recovered during fractionation of the dewaxate into the base stocks.

DETAILED DESCRIPTION

The composition of the Fischer-Tropsch derived base stock produced by the process of the invention is different from one derived from a conventional petroleum oil or slack wax, or a PAO. The base stock of the invention comprises essentially (≧99+ wt. %) all saturated, paraffinic and non-cyclic hydrocarbons. Sulfur, nitrogen and metals are present in amounts of less than 1 wppm and are not detectable by x-ray or Antek Nitrogen tests. While very small amounts of saturated and unsaturated ring structures may be present, they are not identifiable in the base stock by presently known analytical methods, because the concentrations are so small. While the base stock of the invention is a mixture of various molecular weight hydrocarbons, the residual normal paraffin content remaining after hydroisomerization and dewaxing will preferably be less than 5 wt. % and more preferably less than 1 wt. %, with at least 50% of the oil molecules containing at least one branch, at least half of which are methyl branches. At least half, and more preferably at least 75% of the remaining branches are ethyl, with less than 25% and preferably less than 15% of the total number of branches having three or more carbon atoms. The total number of branch carbon atoms is typically less than 25%, preferably less than 20% and more preferably no more than 15% (e.g., 10–15%) of the total number of carbon atoms comprising the hydrocarbon molecules. PAO oils are a reaction product of alphaolefins, typically 1-decene and also comprise a mixture of molecules. However, in contrast to the molecules of the base stock of the invention which have a more linear structure comprising a relatively long back bone with short branches, the classic textbook description of a PAO is a star-shaped molecule, and in particular, tridecane which is illustrated as three decane molecules attached at a central point. PAO molecules have fewer and longer branches than the hydrocarbon molecules that make up the base stock of the invention. Thus, the molecular make up of a base stock of the invention comprises at least 95 wt. % isoparaffins having a relatively linear molecular structure, with less than half the branches having two or more carbon atoms and less than 25% of the total number of carbon atoms present in the branches.

As set forth above, a lubricant, which includes greases and fully formulated lubricating oils (hereinafter "lube oil") is prepared by adding to the base stock an effective amount of at least one additive or, more typically, an additive package containing more than one additive, wherein the additive is at least one of a detergent, a dispersant, an antioxidant, an antiwear additive, a pour point depressant, a VI improver, a friction modifier, a demulsifier, an antifoamant, a corrosion inhibitor, and a seal swell control additive. Of these, those additives common to most formulated lubricating oils include a detergent, a dispersant, an antioxidant, an antiwear additive and a VI improver, with others being optional depending on the intended use of the oil. An effective amount of one or more additives or an additive package containing one or more such additives is added to or blended into the base stock to meet one or more specifications, such as those relating to a lube oil for an internal combustion engine crankcase, an automatic transmission, a turbine or jet, hydraulic oil, etc., as is known. Various manufacturers sell such additive packages for adding to a base stock or to a blend of base stocks to form fully formulated lube oils for meeting performance specifications required for different applications or intended uses, and the exact identity of the various additives present in an additive pack is typically maintained as a trade secret by the manufacturer. However, the chemical nature of the various additives is known to those skilled in the art. For example, alkali metal sulfonates and phenates are well known detergents, with PIBSA (polyisobutylene succinic anhydride) and PIBSA-PAM (polyisobutylene succinic anhydride amine) with or without being borated being well known and used dispersants. VI improvers and pour point depressants include acrylic polymers and copolymers such as polymethacrylates, polyalkylmethacrylates, as well as olefin copolymers, copolymers of vinyl acetate and ethylene, dialkyl fumarate and vinyl acetate, and others which are known. The most widely used antiwear additives are metal dialkyldithiophosphates such as ZDDP in which the metal is zinc, metal carbamates and dithiocarbamates, ashless types which include ethoxylated amine dialkyldithiophosphates and dithiobenzoates. Friction modifiers include glycol esters and ether amines. Benzotriazole is a widely used corrosion inhibitor, while silicones are well known antifoamants. Antioxidants include hindered phenols and hindered aromatic amines such as 2,6-di-tert-butyl4-n-butyl phenol and diphenyl amine, with copper compounds such as copper oleates and copper-PIBSA being well known. This is meant to be an illustrative, but nonlimiting list of the various additives used in lube oils. Thus, additive packages can and often do contain many different chemical types of additives and the performance of the base stock of the invention with a particular additive or additive package can not be predicted a priori. These kinds of additives are known and illustrative examples may be found, for example, in U.S. Pat. Nos. 5,352,374; 5,631,212; 4,764,294; 5,531,911 and 5,512,189. That its performance differs from that of conventional and PAO oils with the same level of the same additives is itself proof of the chemistry of the base stock of the invention being different from that of the prior art base stocks. As set forth above, in many cases it will be advantageous to employ only a base stock derived from waxy Fischer-Tropsch hydrocarbons for a particular lubricant, while in other cases one or more additional base stocks may be mixed with, added to or blended with one or more of the Fischer-Tropsch derived base stocks. Such additional base stocks may be selected from the group consisting of (i) a hydrocarbonaceous base stock, (ii) a synthetic base stock and mixture thereof By hydrocarbonaceous is meant a primarily hydrocarbon type base stock derived from a conventional mineral oil, shale oil, tar, coal liquefaction, mineral oil derived slack wax, while a synthetic base stock will include a PAO, polyester types and other synthetics. Further, because the Fischer-Tropsch base stocks of the invention and lubricating oils based on these base stocks are different, and most often superior to, lubricants formed from other base stocks, it will be obvious to the practitioner that a blend of another base stock with at least 20, preferably at least 40 and more preferably at least 60 wt. % of the Fischer-Tropsch derived base stock will still provide superior properties in many most cases, although to a lesser degree than only if the Fischer-Tropsch derived base stock is used. Thus, in another embodiment, the invention relates to improving a lube oil or other lubricant by forming the lubricant from a base stock which contains at least a portion of a Fischer-Tropsch derived base stock. Depending on the application, using the base stock derived from the Fischer-Tropsch synthesized, waxy hydrocarbon feed according to the practice of the invention, can mean that lower levels of additives are required for a given performance specification, or an improved lube oil is produced at the same additive levels.

During hydroisomerization of the waxy feed, conversion of the 650–750° F.+ fraction to material boiling below this range (lower boiling material, 650–750° F.–) will range from about 20–80 wt. %, preferably 30–70% and more preferably from about 30–60%, based on a once through pass of the feed through the reaction zone. The waxy feed will typically contain 650–750° F.– material prior to the hydroisomerization and at least a portion of this lower boiling material will also be converted into lower boiling components. Any olefins and oxygenates present in the feed are hydrogenated during the hydroisomerization. The temperature and pressure in the hydroisomerization reactor will typically range from 300–900° F. (149–482° C.) and 300–2500 psig, with preferred ranges of 550–750° F. (288–400° C.) and 300–1200 psig, respectively. Hydrogen treat rates may range from 500 to 5000 SCF/B, with a preferred range of 2000–4000 SCFAB. The hydroisomerization catalyst comprises one or more Group VIII catalytic metal components, and preferably non-noble catalytic metal component(s), and an acidic metal oxide component to give the catalyst both a hydrogenation/dehydrogenation function and an acid hydrocracking function for hydroisomerizing the hydrocarbons. The catalyst may also have one or more Group VIB metal oxide promoters and one or more Group IB metals as a hydrocracking suppressant. In a preferred embodiment the catalytically active metal comprises cobalt and molybdenum. In a more preferred embodiment the catalyst will also contain a copper component to reduce hydrogenolysis. The acidic oxide component or carrier may include, alumina, silica-alumina, silica-alumina-phosphates, titania, zirconia, vanadia, and other Group II, IV, V or VI oxides, as well as various molecular sieves, such as X, Y and Beta sieves. The elemental Groups referred to herein are those found in the Sargent-Welch Periodic Table of the Elements, ® 1968. It is preferred that the acidic metal oxide component include silica-alumina and particularly amorphous silica-alumina in which the silica concentration in the bulk support (as opposed to surface silica) is less than about 50 wt. % and preferably less than 35 wt. %. A particularly preferred acidic oxide component comprises amorphous silica-alumina in which the silica content ranges from 10–30 wt. %. Additional components such as silica, clays and other materials as binders may also be used. The surface area of the catalyst is in the range of from about 180–400 $m^2/g$, preferably 230–350 $m^2/g$, with a respective pore volume, bulk density and side crushing strength in the ranges of 0.3 to 1.0 mL/g and preferably 0.35–0.75 mL/g; 0.5–1.0 g/mL, and 0.8–3.5 kg/mm. A particularly preferred hydroisomerization catalyst comprises cobalt, molybdenum and, optionally, copper, together with an amorphous silica-alumina component containing about 20–30 wt. % silica. The preparation of such catalysts is well known and documented. Illustrative, but non-limiting examples of the preparation and use of catalysts of this type may be found, for example, in U.S. Pat. Nos. 5,370,788 and 5,378,348. As was stated above, the hydroisomerization catalyst is most preferably one that is resistant to deactivation and to changes in its selectivity to isoparaffin formation. It has been found that the selectivity of many otherwise useful hydroisomerization catalysts will be changed and that the catalysts will also deactivate too quickly in the presence of sulfur and nitrogen compounds, and also oxygenates, even at the levels of these materials in the waxy feed. One such example comprises platinum or other noble metal on halogenated alumina, such as fluorided alumina, from which the fluorine is stripped by the presence of oxygenates in the waxy feed. A hydroisomerization catalyst that is particularly preferred in the practice of the invention comprises a composite of both cobalt and molybdenum catalytic components and an amorphous alumina-silica component, and most preferably one in which the cobalt component is deposited on the amorphous silica-alumina and calcined before the molybdenum component is added. This catalyst will contain from 10–20 wt. % $MoO_3$ and 2–5 wt. % CoO on an amorphous alumina-silica support component in which the silica content ranges from 10–30 wt. % and preferably 20–30 wt. % of this support component. This catalyst has been found to have good selectivity retention and resistance to deactivation by oxygenates, sulfur and nitrogen compounds found in the Fischer-Tropsch produced waxy feeds. The preparation of this catalyst is disclosed in U.S. Pat. Nos. 5,756,420 and 5,750,819, the disclosures of which are incorporated herein by reference. It is still further preferred that this catalyst also contain a Group IB metal component for reducing hydrogenolysis. The entire hydroisomerate formed by hydroisomerizing the waxy feed may be dewaxed, or the lower boiling, 650–750° F.– components may be removed by rough flashing or by fractionation prior to the dewaxing, so that only the 650–750° F.+ components are dewaxed. The choice is determined by the practitioner. The lower boiling components may be used for fuels.

The dewaxing step may be accomplished using either well known solvent or catalytic dewaxing processes and either the entire hydroisomerate or the 650–750° F.+ fraction may be dewaxed, depending on the intended use of the 650–750° F.– material present, if it has not been separated from the higher boiling material prior to the dewaxing. In solvent dewaxing, the hydroisomerate may be contacted with chilled ketone and other solvents such as acetone, MEK, MIBK and the like and further chilled to precipitate out the higher pour point material as a waxy solid which is then separated from the solvent-containing lube oil fraction which is the raffinate. The raffinate is typically further chilled in scraped surface chillers to remove more wax solids. Low molecular weight hydrocarbons, such as propane, are also used for dewaxing, in which the hydroisomerate is mixed with liquid propane, a least a portion of which is flashed off to chill down the hydroisomerate to precipitate out the wax. The wax is separated from the raffinate by filtration, membranes or centrifugation. The solvent is then stripped out of the raffinate, which is then fractionated to produce the base stocks of the invention. Catalytic dewaxing is also well known in which the hydroisomerate is reacted with hydrogen in the presence of a suitable dewaxing catalyst at conditions effective to lower the pour point of the hydroisomerate. Catalytic dewaxing also converts a portion of the hydroisomerate to lower boiling, 650–750° F.– materials, which are separated from the heavier 650–750° F.+ base stock fraction and the base stock fraction fractionated into two or more base stocks. Separation of the lower boiling material may be accomplished either prior to or during fraction of the 650–750° F.+ material into the desired base stocks.

The practice of the invention is not limited to the use of any particular dewaxing catalyst, but may be practiced with any dewaxing catalyst which will reduce the pour point of the hydroisomerate and preferably those which provide a reasonably large yield of lube oil base stock from the hydroisomerate. These include shape selective molecular sieves which, when combined with at least one catalytic metal component, have been demonstrated as useful for dewaxing petroleum oil fractions and slack wax and include, for example, ferrierite, mordenite, ZSM-5, ZSM-11, ZSM-23, ZSM-35, ZSM-22 also known as theta one or TON, and the silicoaluminophosphates known as SAPO's. A dewaxing catalyst which has been found to be unexpectedly particularly effective in the process of the invention, comprises a noble metal, preferably Pt, composited with H-mordenite. The dewaxing may be accomplished with the catalyst in a fixed, fluid or slurry bed. Typical dewaxing conditions include a temperature in the range of from about 400–600° F., a pressure of 500–900 psig, $H_2$ treat rate of 1500–3500 SCF/B for flow-through reactors and LHSV of 0.1–10, preferably 0.2–2.0. The dewaxing is typically conducted to convert no more than 40 wt. % and preferably no more than 30 wt. % of the hydroisomerate having an initial boiling point in the range of 650–750° F. to material boiling below its initial boiling point.

In a Fischer-Tropsch hydrocarbon synthesis process, a synthesis gas comprising a mixture of $H_2$ and CO is catalytically converted into hydrocarbons and preferably liquid hydrocarbons. The mole ratio of the hydrogen to the carbon monoxide may broadly range from about 0.5 to 4, but which is more typically within the range of from about 0.7 to 2.75 and preferably from about 0.7 to 2.5. As is well known, Fischer-Tropsch hydrocarbon synthesis processes include processes in which the catalyst is in the form of a fixed bed, a fluidized bed and as a slurry of catalyst particles in a hydrocarbon slurry liquid. The stoichiometric mole ratio for a Fischer-Tropsch hydrocarbon synthesis reaction is 2.0, but there are many reasons for using other than a stoichiometric ratio as those skilled in the art know and a discussion of which is beyond the scope of the present invention. In a slurry hydrocarbon synthesis process the mole ratio of the $H_2$ to CO is typically about 2.1/1. The synthesis gas comprising a mixture of $H_2$ and CO is bubbled up into the bottom of the slurry and reacts in the presence of the particulate Fischer-Tropsch hydrocarbon synthesis catalyst in the slurry liquid at conditions effective to form hydrocarbons, at portion of which are liquid at the reaction conditions and which comprise the hydrocarbon slurry liquid. The synthesized hydrocarbon liquid is separated from the catalyst particles as filtrate by means such as simple filtration, although other separation means such as centrifugation can be used. Some of the synthesized hydrocarbons are vapor and pass out the top of the hydrocarbon synthesis reactor, along with unreacted synthesis gas and gaseous reaction products. Some of these overhead hydrocarbon vapors are typically condensed to liquid and combined with the hydrocarbon liquid filtrate. Thus, the initial boiling point of the filtrate will vary depending on whether or not some of the condensed hydrocarbon vapors have been combined with it. Slurry hydrocarbon synthesis process conditions vary somewhat depending on the catalyst and desired products. Typical conditions effective to form hydrocarbons comprising mostly $C_{5+}$ paraffins, (e.g., $C_{5+}$–$C_{200}$) and preferably $C_{10+}$ paraffins, in a slurry hydrocarbon synthesis process employing a catalyst comprising a supported cobalt component include, for example, temperatures, pressures and hourly gas space velocities in the range of from about 320–600° F., 80–600 psi and 100–40,000 V/hrNV, expressed as standard volumes of the gaseous CO and $H_2$ mixture (0° C., 1 atm) per hour per volume of catalyst, respectively. In the practice of the invention, it is preferred that the hydrocarbon synthesis reaction be conducted under conditions in which little or no water gas shift reaction occurs and more preferably with no water gas shift reaction occurring during the hydrocarbon synthesis. It is also preferred to conduct the reaction under conditions to achieve an alpha of at least 0.85, preferably at least 0.9 and more preferably at least 0.92, so as to synthesize more of the more desirable higher molecular weight hydrocarbons. This has been achieved in a slurry process using a catalyst containing a catalytic cobalt component. Those skilled in the art know that by alpha is meant the Schultz-Flory kinetic alpha. While suitable Fischer-Tropsch reaction types of catalyst comprise, for example, one or more Group VIII catalytic metals such as Fe, Ni, Co, Ru and Re, it is preferred in the process of the invention that the catalyst comprise a cobalt catalytic component. In one embodiment the catalyst comprises catalytically effective amounts of Co and one or more of Re, Ru, Fe, Ni, Th, Zr, Hf, U, Mg and La on a suitable inorganic support material, preferably one which comprises one or more refractory metal oxides. Preferred supports for Co containing catalysts comprise titania, particularly. Useful catalysts and their preparation are known and illustrative, but nonlimiting examples may be found, for example, in U.S. Pat. Nos. 4,568,663; 4,663,305; 4,542,122; 4,621,072 and 5,545,674.

As set forth above under the SUMMARY, the waxy feed used in the process of the invention comprises waxy, highly paraffinic and pure Fischer-Tropsch synthesized hydrocarbons (sometimes referred to as Fischer-Tropsch wax), having an initial boiling point in the range of from 650–750° F. and continuously boiling up to an end point of at least 1050° F., preferably above 1050° F. (1050° F.+), and more preferably having a $T_{90}$–$T_{10}$ temperature spread of at least 350° F. The temperature spread refers to the temperature difference in ° F. between the 90 wt. % and 10 wt. % boiling points of the waxy feed, and by waxy is meant including material which solidifies at standard conditions of room temperature and pressure. The temperature spread, while preferably being at least 350° F., is more preferably at least 400° F. and still more preferably at least 450° F. and may range between 350° F. to 700° F. or more. Waxy feed obtained from a slurry Fischer-Tropsch process employing a catalyst comprising a composite of a catalytic cobalt component and a titania component have been made having $T_{10}$ and $T_{90}$ temperature spreads of as much as 490° F. and even 600° F., having more than 10 wt. % of 1050° F.+ material and even more than 15 wt. % of 1050° F.+ material, with respective initial and end boiling points of 500° F.–1245° F. and 350° F.–1220° F. Both of these samples continuously boiled over their entire boiling range. The lower boiling point of 350° F. was obtained by adding some of the condensed hydrocarbon overhead vapors from the reactor to the hydrocarbon liquid filtrate removed from the reactor. Both of these waxy feeds were suitable for use in the process of the invention, in that they contained material having an initial boiling point of from 650–750° F. which continuously boiled to an end point of above 1050° F., and a $T_{90}$–$T_{10}$ temperature spread of more than 350° F. Thus, both feeds comprised hydrocarbons having an initial boiling point of 650–750° F. and continuously boiled to an end point of more than 1050° F. These waxy feeds are very pure and contain negligible amounts of sulfur and nitrogen compounds. The sulfur and nitrogen contents are less than 1 wppm, with less than 500 wppm of oxygenates measured as oxygen, less than 3 wt. % olefins and less than 0.1 wt. % aromatics. The low oxygenate content of preferably less than 1,000 and more preferably less than 500 wppm results in less hydroisomerization catalyst deactivation.

The invention will be further understood with reference to the examples below. In all of these examples, the $T_{90}$–$T_{10}$ temperature spread was greater than 350° F.

EXAMPLES

In the following Examples, a fully formulated lubricating oil was obtained by adding 21 parts by weight of an Adpack A containing various additives to 79 parts by weight of the base stock or 13 parts by weight of an Adpack B to 87 parts by weight of the base stock. Lubricating oils using Adpack A were used in Examples 2 and 3, while lubricating oils using Adpack B were used in Examples 6–9. Adpack A comprised mostly a viscosity modifier and a PIBSA-PAM dispersant, along with effective amounts of detergents, an antioxidant, a ZDDP antiwear additive, demulsifier and antifoaming agent. Adpack B comprised PIPSA-PAM and PIPSA dispersants, an antiwear additive, detergents, antioxidants, friction modifier, demulsifier and antifoam agent.

Example 1

A synthesis gas comprising a mixture of $H_2$ and CO in a mole ratio ranging between 2.11–2.16 was fed into a slurry Fischer-Tropsch reactor in which the $H_2$ and CO were reacted in the presence of a titania supported cobalt rhenium catalyst to form hydrocarbons, most of which were liquid at the reaction conditions. The reaction was carried out at 422–428° F., 287–289 psig, and the gas feed was introduced up into the slurry at a linear velocity of from 12–17.5 cm/sec. The alpha of the hydrocarbon synthesis reaction was greater than 0.9. The paraffinic Fischer-Tropsch hydrocarbon product was subjected to a rough flash to separate and recover a 700° F.+ boiling fraction which served as the waxy feed for the hydroisomerization. The paraffinic Fischer-Tropsch hydrocarbon product was subjected to a rough flash to separate and recover three nominally different boiling fractions. They were (a) $C_5$–500° F., (b) 500–700° F. and a 700° F.+ fraction, which served as the waxy feed for the hydroisomerization.

The 700° F.+ waxy feed was hydroisomerized by reacting it with hydrogen, at about a 50% conversion (i.e., 50% of the 700° F.+ waxy feed was converted to 700° F.−) to lower boiling material (fuels) in the presence of a catalyst which consisted of cobalt, nickel and molybdenum (3.6 wt. % CoO, 16.4 wt. % $MoO_3$ and 0.66 wt. % NiO) impregnated on an amorphous alumina-silica support of which 13.7 wt. % was silica and with the support having a surface area of 270 $m^2/g$ with a pore volume of <30 mm equal to 0.43. The conditions and yields of the hydroisomerization, along with the amount of 650° F.+ and 650° F.− fractions obtained in a 15/5 atmospheric distillation are given in Table 1.

The 650° F.+ fraction recovered from the 15/5 distillation was then further fractionated under high vacuum to produce a 140N waxy oil. This 140N waxy oil was then solvent dewaxed to remove waxy hydrocarbons and reduce the pour point of the oil to about −18° C. (0° F.) to form a base stock of the invention. The dewaxing conditions are given in Table 2, while the physical properties, yield of dewaxed oil, and corresponding dry wax content for the base stock is given in Table 3.

TABLE 1

| Hydroisomerization Conditions and Yields | |
|---|---|
| 700° F.+ Conversion*, wt. % | 50 |
| Reactor Temperature, ° F. | 702 |
| Space Velocity, (v/v/h) | 0.45 |
| Pressure, psig | 1000 |
| Hydrogen Treat Rate, SCF/B | 2500 |

TABLE 1-continued

| Hydroisomerization Conditions and Yields | |
|---|---|
| Yields (wt. % on Feed) | |
| C1–C4 | 2.11 |
| C5-320° F. | 9.75 |
| 320–550° F. | 17.92 |
| 550–700° F. | 24.63 |
| 700° F.+ | 45.59 |
| 15/5 Composite Distillation, wt. % | |
| IBP-650° F. | 44.26 |
| 650° F.+ | 55.74 |

*700° F.+ Conv. = [1-(wt. % 700° F.+ in product) ÷ (wt. % 700° F.+ in feed)] × 100

The waxy feed was hydroisomerized by reacting with hydrogen in the presence of a dual function catalyst having an isomerization and a hydrocracking function to form a mixture of normal paraffins and isoparaffins at a feed conversion rate of about 50 wt. % to lower boiling material useful as fuels. That is, 50 wt. % of the 700° F.+ boiling waxy feed was converted to 700° F.− boiling hydrocarbons. The hydroisomerization catalyst comprised cobalt, nickel and molybdenum (3.6 wt. % CoO, 16.4 wt. % $MoO_3$ and 0.66 wt. % NiO) impregnated on an amorphous alumina-silica support of which 13.7 wt. % was silica and with the support having a surface area of 270 $m^2/g$ with a pore volume of <30 mm equal to 0.43. The hydroisomerization conditions and yields, along with the amount of 650° F.+ and 650° F.− fractions obtained in a 15/5 atmospheric distillation are given in Table 1.

The 650° F.+ fraction was further fractionated under high vacuum to produce a 140N viscosity oil which was then solvent dewaxed to reduce the pour point to about −18° C. (0° F.) and produce a lubricating oil base stock of the invention. The yield, properties and corresponding dry wax content for the base stock are given in Table 3.

TABLE 2

| Dewaxing Conditions | |
|---|---|
| Solvent | MEK/MIBK (50/50) |
| Solvent/Oil Ratio | 2.4:1 |
| Filter Temperature, ° C. | −18 |
| Dewaxing Yield, LV % | 79.8 |
| Dry Wax Content | 4.8 |

TABLE 3

| Dewaxed Oil (Base Stock) Properties | |
|---|---|
| Kinematic Viscosity at 40° C., cSt | 27.12 |
| Kinematic Viscosity at 100° C., cSt | 5.51 |
| Viscosity Index | 145 |
| Pour Point, ° C. | −19 |
| Noak, wt. % | 8.6 |
| CCS Viscosity at −20° C., cP | 710 |
| Yield, LV % on 700° F.+ Hydroisomerate | 49.3 |

Example 2

Three SAE 15W-40 fully formulated oils were evaluated for deposit control capabilities in the panel coker deposit test (Federal Test Method STD No. 791b). Each oil contained the same additive package (Adpack A above), but the lubricating base stock was varied. The base stock of the invention was the solvent dewaxed hydroisomerate prepared according to Example 1. The three oils were (i) a conventional mineral oil base stock (S150N), (ii) a synthetic polyalphaolefin (PAO), and (iii) the base stock of the invention (F-T). This test method is used for determining the tendency of finished oils to form coke deposits when in contact with metal surfaces at elevated temperatures for relatively short periods of time. In consists in mechanically splashing the oil (300 g) for one hour against a plate at 300, 320, 338 and 345° C, and determining the weight of the coke deposited. The lower the weight of the deposit, the better the performance of the oil. The results are given in Table 4 below. These results indicate that the fully formulated oil based on the solvent dewaxed base stock of the invention exhibits superior deposit resistance relative to those based on both the conventional and PAO base stocks, particularly at higher temperatures. They also demonstrate that the composition of the base stock of the invention is different in composition from the other two base stocks, as demonstrated by the different response to the test.

TABLE 4

| Panel Coker Deposit Test Results | | | |
|---|---|---|---|
| | Coke Deposit, mg | | |
| Temperature, ° C. | S150N | PAO | F-T |
| 300 | 25 | 26 | 28 |
| 320 | 35 | 69 | 45 |
| 338 | 101 | 135 | 98 |
| 345 | 140 | 237 | 101 |

Example 3

The same three oils used in Example 2 above were evaluated in the thin film oxygen uptake test (TFOUT), ASTM Test No. D 4742-88. The test consists of placing 1.5 g of the oil in a stainless steel containing an oxidation catalyst and water. The reactor is sealed, charged with 90 psig of oxygen, placed in an oil bath at 160° C. and rotated at 100 rpm. The period of time that elapses between the time when the reactor is placed in the oil bath and the time when the decrease in pressure is observed is referred to as the oxidative induction time. This number is an indication of the oil's oxidation stability, with a longer time indicating greater stability. The results are given in Table 5 and indicate that the lube oil containing the base stock of the invention exhibits superior oxidation stability relative to the oils based on both the conventional and PAO base oils.

TABLE 5

| TFOUT Oxidation Test Results | |
|---|---|
| Base Stock | Oxidation Induction Time, min. |
| S150N | 45 |
| PAO | 105 |
| F-T | 107 |

Example 4

As was the case for Examples 1–3, in this experiment the waxy feed was also formed from a synthesis gas feed comprising a mixture of $H_2$ and CO having a mole ratio of between 2.11–2.16 which was reacted in a slurry comprising bubbles of the synthesis gas and particles of a Fischer- Tropsch hydrocarbon synthesis catalyst comprising cobalt and rhenium supported on titania dispersed in the hydrocarbon slurry liquid. The slurry liquid comprised hydrocarbon products of the synthesis reaction which were liquid at the reaction conditions. These included a temperature of 425° F., a pressure of 290 psig and a gas feed linear velocity of from 12 to 18 cm/sec. The of the synthesis step was greater than 0.9. The boiling point distribution of the synthesized hydrocarbons is given in Table 6. As was the case above, the 700° F.+ fraction was recovered by fractionation, as the waxy feed of the invention for the hydroisomerization step

TABLE 6

| Wt. % Boiling Point Distribution of Fischer-Tropsch Reactor Waxy Feed | |
|---|---|
| IBP-500° F. | 1.0 |
| 500–700° F. | 28.1 |
| 700° F.+ | 70.9 |
| (1050° F.+) | (6.8) |

Example 5

The 700° F.+ waxy feed shown in Example 4 was hydroisomerized by reacting with hydrogen in the presence of a dual function hydroisomerization catalyst which consisted of cobalt (CoO, 3.2 wt. %) and molybdenum ($MoO_3$, 15.2 wt. %) on an amorphous alumina-silica cogel acidic support, 15.5 wt. % of which was silica. Thus, this hydroisomerization catalyst, unlike that used in the previous examples, did not contain nickel. The catalyst had a surface area of 266 $m^2/g$ and a pore volume ($P.V._{H2O}$) of 0.64 mL/g. The hydroisomerization conditions are given in Table 7 and were selected for a target of 50 wt. % feed conversion of the 700° F.+ fraction, which again is defined as:

$$700° \text{ F.+ Conv.}=[1-(\text{wt. \% } 700° \text{ F.+ in product})\div(\text{wt. \% } 700° \text{ F.+ in feed})]\times 100$$

TABLE 7

| Hydroisomerization Reaction Conditions | |
|---|---|
| Temperature, ° F. (° C.) | 713 (378) |
| $H_2$ Pressure, psig (pure) | 725 |
| $H_2$ Treat Gas Rate, SCF/B | 2500 |
| LRSV, v/v/h | 1.1 |
| Target 700° F.+ Conversion, wt. % | 50 |

Thus, during the hydroisomerization the entire feed was hydroisomerized, with 50 wt. % of the 700° F.+ waxy feed converted to 700° F.− boiling products.

The 700° F.+ hydroisomerate was recovered by fractionation and then catalytically dewaxed to reduce the pour point by reacting with hydrogen in the presence of a dewaxing catalyst which comprised platinum on a support comprising 70 wt. % of the hydrogen form of mordenite and 30 wt. % of an inert alumina binder. The dewaxing conditions are given in Table 8. The dewaxate was then fractionated in a HIVAC distillation to yield the desired viscosity grade of a lubricating oil base stock of the invention. The properties of the base stock are shown in Table 9.

TABLE 8

| Catalytic Dewaxing Conditions | |
|---|---|
| Temperature, ° F. | 480–550 |
| $H_2$ Pressure, psig. | 725 |
| $H_2$ Treat Gas Rate, SCF/B | 2500 |
| LHSV, v/v/h | 1.1 |
| Target Lube Yield, wt. % | 80 |

TABLE 9

| Dewaxed Oil Properties | |
|---|---|
| Kinematic Viscosity at 40° C., cSt | 25.20 |
| Kinematic Viscosity at 100° C., cSt | 5.22 |
| Viscosity Index | 143 |
| Pour Point, ° C. | −16 |
| Noak, wt. % | 13 |
| CCS Viscosity at −20° C., cP | 810 |
| Yield, LV % on 700° F.+ Hydroisomerate | 76.4 |

Example 6

As was the case for the three fully formulated oils evaluated in Example 3, in this example three fully formulated 15W-40 automotive lubricating oils were prepared or evaluation in the TFOUT test, differing only in the base stock to which the additive package (Adpack B above) was added. The results, which are given in Table 10, show that the lubricating oil based on the base stock of the invention (F-T) exhibited the best oxidation resistance.

TABLE 10

TFOUT Oxidation Test Results

| Base Stock | Oxidation Induction Time, min. |
|---|---|
| S150N | 45 |
| PAO | 106 |
| F-T | 109 |

Example 7

In this experiment, four fully formulated SAE 10W-30 automotive lubricating oils were prepared all using the same additive package (Adpack B above) and differing from each other in the base stock used and in the amount of additive package blended in with each base stock. That is, the additive package was employed at three different treat levels. These were, a full additive level of 13 wt. % of the final oil, half treat and a quarter treat. The reduced treat rates were used to amplify the effect of the base stocks. In addition to the S150N, PAO and the base stock of the invention (F-T), a hydrocracked base stock was also used. The base stock of the invention used for these experiments was the same one used in Example 6. These lube oils were evaluated in the TFOUT test and the results, given in Table 11, suggest that the use of the base stock of the invention imparts significantly increased oxidation stability to the lubricating oil with lower additive package treat levels, than the two other base stocks for similar performance levels. This implies significant savings when using the base stock of the invention.

TABLE 11

| TFOUT Oxidation Test Results | | | |
|---|---|---|---|
| | Oxidation Induction Time, min. Additive Package Treat Rate, wt. % | | |
| Base Stock | 13% | 6.5% | 3.6% |
| S150N | 60 | 31 | 14 |
| PAO | 64 | 36 | 24 |
| Hydrocracked | 67 | 36 | 20 |
| F-T | 67 | 42 | 23 |

Example 8

In this experiment, three fully formulated SAE 15W-40 automotive lubricating oils were prepared using the three different base stocks of Example 6 to which was added the same amount of a current European heavy duty additive package (Adpack B above). The cold cranking simulator (CCS) viscosity of each oil was determined at various temperatures according to ASTM D-2602. ASTM Engine Oil Viscosity Classification SAE J300 permits a maximum CCS viscosity in centipoise (cP) for a 15W oil of 3500 at −15° C. The results given in Table 12 show that both the PAO based oil and that of the invention (F-T) were somewhat similar in performance in more than meeting the specification and in being superior to the oil based on the conventional base stock.

TABLE 12

| Base stock | Temperature, ° C. | CCS Viscosity, cP |
|---|---|---|
| Solvent 150N, 5.2 cs @100° C. | −14.9 | 2770 |
| | −22.0 | 8040 |
| | −24.25 | 11900 |
| | −24.97 | 13690 |
| PAO, 5.2 cs @100° C. | −11.8 | 940 |
| | −15.0 | 1120 |
| | −20.0 | 1760 |
| | −25.03 | 2830 |
| F-T, 5.2 cs @100° C. | −13.0 | 1050 |
| | −13.7 | 1170 |
| | −19.6 | 2060 |
| | −25.02 | 3850 |

Example 9

This experiment was similar to Example 7 and used the same base stock of the invention and Adpack B above. In this experiment six SAE 15W-40 fully formulated (full additive package) and partially formulated (½ additive package) automotive lube oils were evaluated in the thin film oxygen uptake test (TFOUT, ASTM test number D 4742-88). Each lube oil contained the same additive package at the two treat levels, differing in the base stock used. The results are given in Table 13 and again show the superior properties of a lube oil formulated using a base stock of the invention. It also demonstrates, by the different responses of the lube oils, that the base stock of the invention is different from the PAO and conventional base stocks.

TABLE 13

| | Oxidative Induction time, min. | |
|---|---|---|
| Base Stock | Full Additive Package | ½ Additive Package |
| S150N | 74 | 32 |
| PAO | 143 | 72 |
| F-T | 166 | 84 |

It is understood that various other embodiments and modifications in the practice of the invention will be apparent to, and can be readily made by, those skilled in the art without departing from the scope and spirit of the invention described above. Accordingly, it is not intended that the scope of the claims appended hereto be limited to the exact description set forth above, but rather that the claims be construed as encompassing all of the features of patentable novelty which reside in the present invention, including all the features and embodiments which would be treated as equivalents thereof by those skilled in the art to which the invention pertains.

What is claimed is:

1. A lubricant comprising an isoparaffinic base stock comprising at least 95 wt. % non-cyclic isoparaffins derived from waxy, paraffinic, Fischer-Tropsch synthesized hydrocarbons and an effective amount of at least one lubricant additive.

2. A lubricant according to claim 1 wherein at least 50% of the isoparaffinic lubricant molecules contain at least one branch and at least half of said branches being methyl branches.

3. A lubricant according to claim 2 wherein said lubricant additive is selected from the group consisting of a detergent, a dispersant, an antioxidant, an antiwear additive, a pour point depressant, a VI improver, a friction modifier, a demulsifier, an antifoamant, a corrosion inhibitor, a seal swell control additive and mixture thereof, and wherein less than 25% of the total number of carbon atoms are present in the branches of said isoparaffinic molecules in said isoparaffinic base stock.

4. A lubricant according to claim 3 containing a detergent, a dispersant, an antioxidant, an antiwear additive and a VI improver.

5. A lubricant according to claim 4 selected from the group consisting of a multigrade internal combustion engine crankcase oil, a transmission oil, a turbine oil and a hydraulic oil.

6. A lubricant according to claim 5 further containing a pour point depressant and a demulsifier.

7. A lubricant according to claim 2 comprising said Fischer-Tropsch derived base stock and at least one other base stock selected from the group consisting of (i) a hydrocarbonaceous base stock, (ii) a synthetic base stock and mixture thereof.

8. A lubricant according to claim 7 wherein at least 20 wt. % of said base stock comprises said Fischer-Tropsch derived base stock and wherein said Fischer-Tropsch derived base stock comprises saturated paraffinic and non-cyclic hydrocarbons.

9. A lubricant according to claim 7 wherein at least 40 wt. % of said base stock comprises said Fischer-Tropsch derived base stock.

10. A lubricant according to claim 7 wherein at least 60 wt. % of said base stock comprises said Fischer-Tropsch derived base stock.

11. A lubricating oil comprising an isoparaffinic base stock derived from waxy, paraffinic, Fischer-Tropsch hydrocarbons and an effective amount of at least one lubricating oil additive, wherein said base stock comprises at least 95 wt. % non-cycle isoparaffins having a molecular structure with less than half the branches having two or more carbon atoms and with less than 25% of the total number of carbon atoms present in the branches.

12. A lubricating oil according to claim 11 wherein at least half of the isoparaffin molecules contain at least one branch, at least half of which are methyl branches.

13. A lubricating oil according to claim 12 wherein at least half of the remaining, non-methyl branches on said isoparaffin molecules are ethyl, with less than 25% of the total number of branches having three or more carbon atoms.

14. A lubricating oil according to claim 13 wherein at least 75% of the non-methyl branches on said isoparaffinic base stock isoparaffin molecules are ethyl.

15. A lubricating oil according to claim 14 wherein the total number of branch carbon atoms on said isoparaffinic base stock molecules is from 10–15% of the total number of carbon atoms comprising said isoparaffin molecules.

16. A lubricating oil according to claim 11 wherein said base stock comprises said Fischer-Tropsch derived, isoparaffinic base stock in admixture with at least one base stock selected from the group consisting of (i) a hydrocarbonaceous base stock and (ii) a synthetic base stock.

17. A lubricating oil according to claim 15 wherein said base stock comprises said Fischer-Tropsch derived, isoparaffmic base stock in admixture with at least one base stock selected from the group consisting of (i) a hydrocarbonaceous base stock and (ii) a synthetic base stock.

18. A lubricant comprising an isoparaffinic base stock comprising at least 95 wt. % non-cyclic isoparaffins derived from a waxy, paraffinic hydrocarbon feed produced by a Fischer-Tropsch hydrocarbon synthesis process and an effective amount of at least one lubricant additive, wherein said base stock is produced by a process which comprises hydroisomerizing and dewaxing said waxy feed.

19. A lubricant according to claim 18 wherein said process comprises (i) hydroisomerizing said waxy, paraffinic, Fischer-Tropsch synthesized hydrocarbon feed having an initial boiling point in the range of 650–750° F., an end point of at least 1050° F. and a $T_{90}$–$T_{10}$ temperature spread of at least 350° F. to form a hydroisomerate having an initial boiling point in said 650–750° F. range, (ii) dewaxing said 650–750° F.+ hydroisomerate to reduce its pour point and form a 650–750° F.+ dewaxate, and (iii) fractionating said 650–750° F.+ dewaxate to form two or more fractions of different viscosity, at least one of which comprises said base stock.

20. A lubricant according to claim 19 wherein said waxy feed used in said process continuously boils over its boiling range, has an end boiling point above 1050° F. and comprises more than 95 wt. % normal paraffins.

21. A lubricant according to claim 20 wherein said hydroisomerization comprises reacting said waxy feed with hydrogen in the presence of a hydroisomerization catalyst having both a hydroisomerization function and a hydrogenation/dehydrogenation function and wherein said hydroisomerization catalyst comprises a catalytic metal component and an acidic metal oxide component.

22. A lubricant according to claim 21 wherein said waxy feed used in said process has less than 1 wppm of nitrogen compounds, less than 1 wppm of sulfur and less than 1,000 wppm of oxygen in the form of oxygenates.

23. A lubricant according to claim 22 wherein said catalyst used for said hydroisomerization comprises a Group VIII non-noble catalytic metal component and, optionally, one or more Group VIB metal oxide promoters and one or more Group IB metals to reduce hydrogenolysis, and wherein said acidic metal oxide component comprises amorphous silica-alumina.

24. A lubricant according to claim 18 wherein said base stock comprises said Fischer-Tropsch derived, isoparaffinic base stock in admixture with at least one of (i) a hydrocarbonaceous base stock and (ii) a synthetic base stock.

25. A lubricant according to claim 19 wherein said base stock comprises said Fischer-Tropsch derived, isoparaffinic base stock in admixture with at least one of (i) a hydrocarbonaceous base stock and (ii) a synthetic base stock.

26. A lubricant according to claim 23 wherein said base stock comprises said Fischer-Tropsch derived, isoparaffinic base stock in admixture with at least one of (i) a hydrocarbonaceous base stock and (ii) a synthetic base stock.

27. A process for making a lubricant which comprises combining an effective amount of at least one lubricant additive to an isoparaffinic base stock which comprises at least 95 wt. % non-cyclic isoparaffin molecules, wherein said base stock is formed by a process which comprises (i) reacting $H_2$ and CO in the presence of a Fischer-Tropsch hydrocarbon synthesis catalyst in a slurry at reaction conditions effective to form a waxy paraffinic feed having an initial boiling point in the range of 650–750° F. and continuously boiling up an end point of at least 1050° F., and having a $T_{90}$–$T_{10}$ temperature difference of at least 350° F., wherein said slurry comprises gas bubbles and said synthesis catalyst in a slurry liquid which comprises hydrocarbon products of said reaction which are liquid at said reaction conditions and which includes said waxy feed fraction (ii) hydroisomerizing said waxy feed to form a hydroisomerate having an initial boiling point between 650–750° F., (iii) dewaxing said 650–750° F.+ hydroisomerate to reduce its pour point and form a 650–750° F.+ dewaxate, and (iv) fractionating said 650–750° F.+ dewaxate to form two or more fractions of different viscosity, recovering said fractions and using at least one of said fractions as said isoparaffinic base stock.

28. A process for making a lubricant according to claim 27 further comprising combining said at least one additive and said isoparaffinic base stock and at least one of (i) a hydrocarbonaceous base stock and (ii) a synthetic base stock.

29. A process according to claim 27 wherein said Fischer-Tropsch catalyst comprises a cobalt catalytic component.

30. A process according to claim 28 wherein said Fischer-Tropsch catalyst comprises a cobalt catalytic component.

* * * * *